US006642809B2

(12) United States Patent
Shin et al.

(10) Patent No.: US 6,642,809 B2
(45) Date of Patent: Nov. 4, 2003

(54) MULTI-LAYER CHIP DIRECTIONAL COUPLER

(75) Inventors: Ji-Hwan Shin, Kyungki-do (KR); Seung-Gyo Jeong, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/011,317

(22) Filed: Dec. 11, 2001

(65) Prior Publication Data

US 2002/0110326 A1 Aug. 15, 2002

(30) Foreign Application Priority Data

Dec. 19, 2000 (KR) ..... 2000-078294

(51) Int. Cl.[7] ..... H01P 3/08
(52) U.S. Cl. ..... 333/116; 333/112
(58) Field of Search ..... 333/116, 238, 333/246, 112, 118, 109, 25, 26, 24 R

(56) References Cited

U.S. PATENT DOCUMENTS 5,530,922 A * 6/1996 Nagode ..... 455/126
5,841,328 A * 11/1998 Hayashi ..... 333/116
6,483,398 B2 * 11/2002 Nagamori et al. ..... 333/116

* cited by examiner

*Primary Examiner*—Robert Pascal
*Assistant Examiner*—Kimberly E Glenn
(74) *Attorney, Agent, or Firm*—Lowe, Hauptman Gilman & Berner LLP

(57) ABSTRACT

Disclosed herein is a multi-layer chip directional coupler. The multi-layer chip directional coupler has a first ground pattern, a coupling signal line, a main signal line, a second ground pattern, and a plurality of ports. The first ground pattern is formed on the upper surface of a first dielectric layer. The coupling signal line is formed of a conduction pattern on the upper surface of a second dielectric layer. The main signal line is formed of a conduction pattern on the upper surface of a third dielectric layer formed over the second dielectric layer. The second ground pattern formed on the upper surface of a fourth dielectric layer formed over the third dielectric layer. A plurality of ports is formed on the side surfaces of the first to fourth dielectric layers.

4 Claims, 3 Drawing Sheets

MULTI-LAYER CHIP DIRECTIONAL COUPLER

BACKGROUND OF THE INVENTION

1. Field of the Invention

The present invention relates generally to directional couplers, and more particularly to a multi-layer chip directional coupler, in which a main signal line layer is formed on one dielectric layer, such that the main signal line layer is shorter than a coupling signal line layer formed on two dielectric layers, thus decreasing resistance of a conduction pattern and reducing insertion loss.

2. Description of the Prior Art

Recently, as mobile communication fields are rapidly developed, a usable frequency becomes higher and its bandwidth becomes narrower. Therefore, because parts adapted to such mobile communication devices must satisfy the requirements for high frequency and narrow bandwidth, required design conditions are more and more complicated.

A directional coupler used in the mobile communication devices serves to divide transmission signals at a constant rate. Especially, in the directional coupler, a certain amount of output signals from an amplifier of a transmission stage are sampled and transmitted to an automatic output controller, thus enabling an output signal having a constant output level to be transmitted through an antenna.

FIG. 1 is a view showing a conventional microstripline coupler. Referring to FIG. 1, in the microstripline coupler, a conductive metal is layered on a dielectric substrate 1 having a predetermined dielectric constant, such that a main signal line 3 and a coupling signal line 5 are formed to be spaced apart from each other. When signals are inputted to an input port of the coupler, most of the input signals are outputted through an output terminal. However, some part of the input signals are coupled to the coupling signal line 5, such that a coupling signal is generated by the coupling signal line 5, and outputted through a coupling port and an isolation port.

Generally, in the microstripline coupler having the above construction, coupling characteristics are decided according to a distance between the main signal line 3 and the coupling signal line 5 and their pattern shapes. Especially, the distance between the main signal line 3 and the coupling signal line 5 is a primary factor adjusted in the manufacturing process of the coupler. However, it is very difficult to accurately maintain the distance between the main signal line 3 and the coupling signal line 5 in the actual microstripline coupler.

Consequently, the conventional microstripline coupler is problematic in that it is very difficult to manufacture a coupler having highly coupled structure due to variation of the distance between the main signal line and the coupling signal line when the coupler is manufactured.

In order to solve the problem, a multi-layer chip directional coupler shown in FIG. 2 is proposed. Referring to FIG. 2, the multi-layer chip directional coupler is completely manufactured by forming electrode patterns on a plurality of dielectric layers and cohering the dielectric layers. As shown in FIG. 2, ground patterns 17*a* and 17*b* are respectively formed on the lowermost and uppermost dielectric layers 10*a* and 10*f*. Two dielectric layers 10*b* and 10*c* on which signal lines 13*a* and 13*b* are respectively formed are arranged in parallel with each other over the lowermost dielectric layer 10*a*. A via hole 20*a* is formed on the dielectric layer 10*c*, such that the signal lines 13*a* and 13*b* are connected to each other through the via hole 20*a*.

Further, over the dielectric layer 10*c*, two dielectric layers 10*d* and 10*e* on which coupling signal lines 15*a* and 15*b* are respectively formed are arranged in parallel with each other. The coupling signal lines 15*a* and 15*b* are connected to each other through a via hole 20*b* formed on the dielectric layer 10*e*. In this case, both the main signal lines 13*a* and 13*b*, and the coupling signal lines 15*a* and 15*b* respectively formed on different two dielectric layers are symmetrically arranged as shown in FIG. 2. The dielectric layer 10*f* on which the ground pattern 17*b* is formed is arranged over the dielectric layer 10*e*, and a case 10*g* made of an insulating material is arranged over the dielectric layer 10*f*. Accordingly, the layers 10*a* to 10*g* are cohered to each other, such that the multi-layer chip directional coupler is completely manufactured.

In the conventional multi-layer directional coupler of FIG. 2, required coupling characteristics can be obtained by setting the distance between the main signal lines and the coupling signal lines around the dielectric layer 10*d* having a predetermined thickness. Further, the conventional multi-layer directional coupler of FIG. 2 is advantageous in that it can easily set the coupling characteristics by symmetrically manufacturing the main and coupling signal lines so as to form the patterns of the main and coupling signal lines to be the same, and it can simplify the manufacturing process of the coupler by symmetrically forming conduction patterns on each dielectric layer.

However, the conventional multi-layer chip directional coupler is problematic in that it has large insertion loss. The insertion loss is an amount of loss generated within a coupler chip except an amount of sampled signals in the coupler and output signals outputted through the main signal lines, and is a significant factor for defining the characteristics of the directional coupler. However, in the conventional multi-layer chip directional coupler having the symmetrical structure, because the main signal lines 13*a* and 13*b* are manufactured to have the same length as the coupling signal lines 15*a* and 15*b*, resistances are increased according to the length of the main signal lines 13*a* and 13*b*, thereby increasing the insertion loss.

SUMMARY OF THE INVENTION

Accordingly, the present invention has been made keeping in mind the above problems occurring in the prior art, and an object of the present invention is to provide a multi-layer chip directional coupler, in which a main signal line is asymmetrically formed to be shorter than a coupling signal line, thus simplifying the manufacturing process of the directional coupler, decreasing insertion loss.

In order to accomplish the above object, the present invention provides a multi-layer chip directional coupler, comprising a first ground pattern formed on the upper surface of a first dielectric layer; a coupling signal line formed of a conduction pattern on the upper surface of a second dielectric layer formed over the first dielectric layer; a main signal line formed of a conduction pattern on the upper surface of a third dielectric layer formed over the second dielectric layer, the main signal line being shorter than the coupling signal line; a second ground pattern formed on the upper surface of a fourth dielectric layer formed over the third dielectric layer; and a plurality of ports formed on the side surfaces of the first to fourth dielectric layers and connected to the main signal line, the coupling signal line, and the first and second ground patterns.

According to a preferred embodiment, the second or third dielectric layer can be comprised of a plurality of dielectric layers. In this case, conduction patterns forming the coupling signal line or the main signal line respectively formed on the upper surface of the second or third dielectric layer are connected to each other through a via hole penetrating through a plurality of dielectric layers to be one line.

According to another preferred embodiment, preferably the length of the main signal line is set to be approximately half that of the coupling signal line so as to reduce insertion loss.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
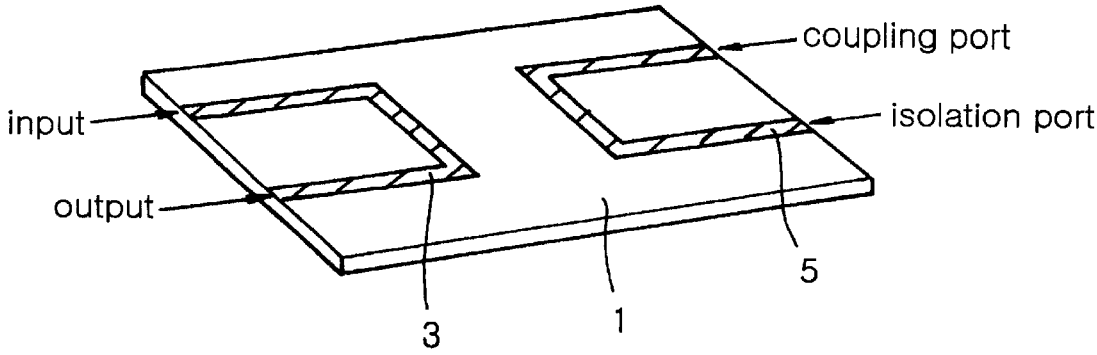
PRIOR ART FIG. 1
FIG. 1 is a view showing the structure of a conventional microstripline directional coupler.
Figure 2:
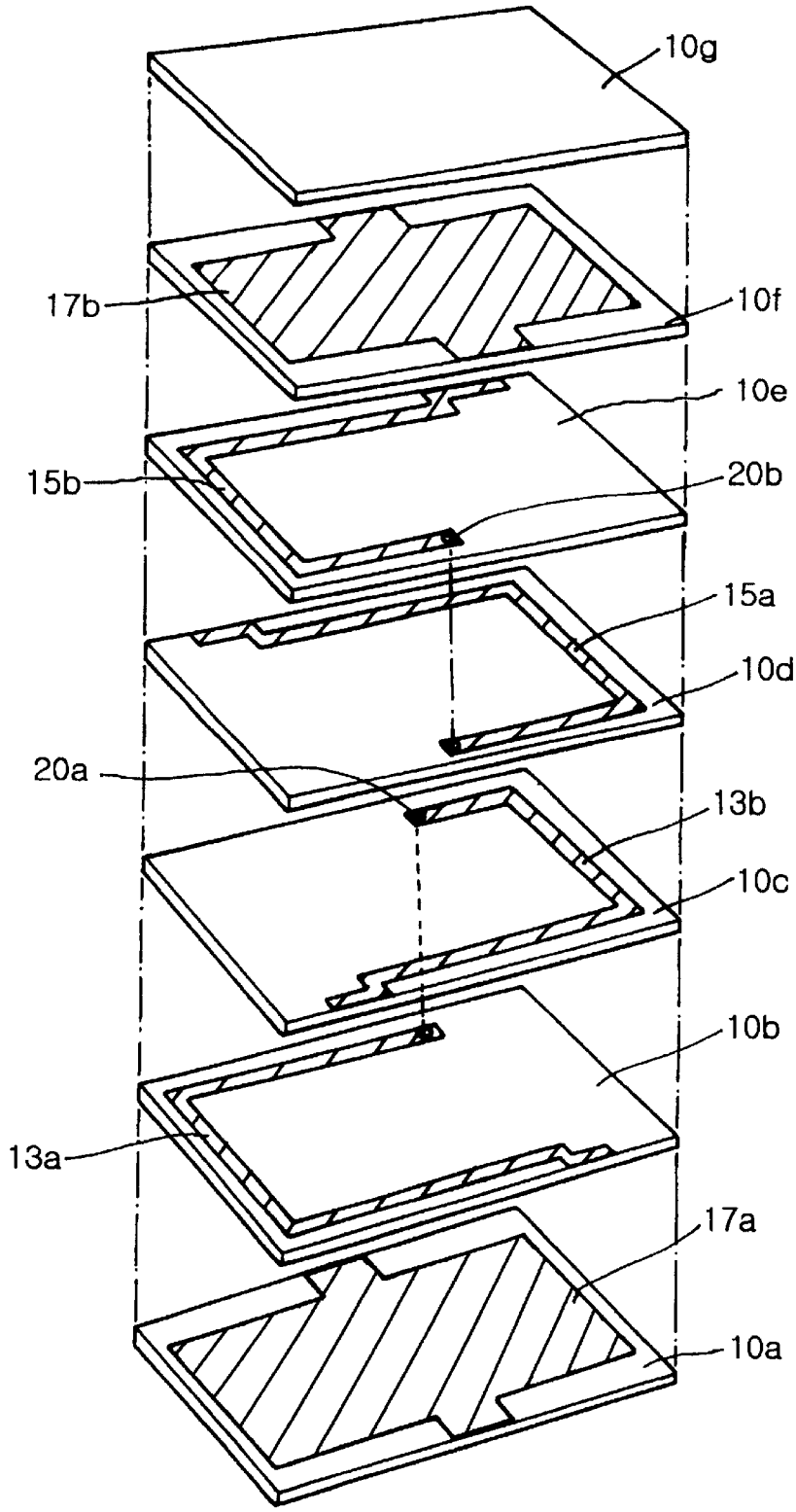
PRIOR ART FIG. 2
FIG. 2 is an exploded perspective view showing the structure of a conventional multi-layer chip directional coupler.
Figure 3:
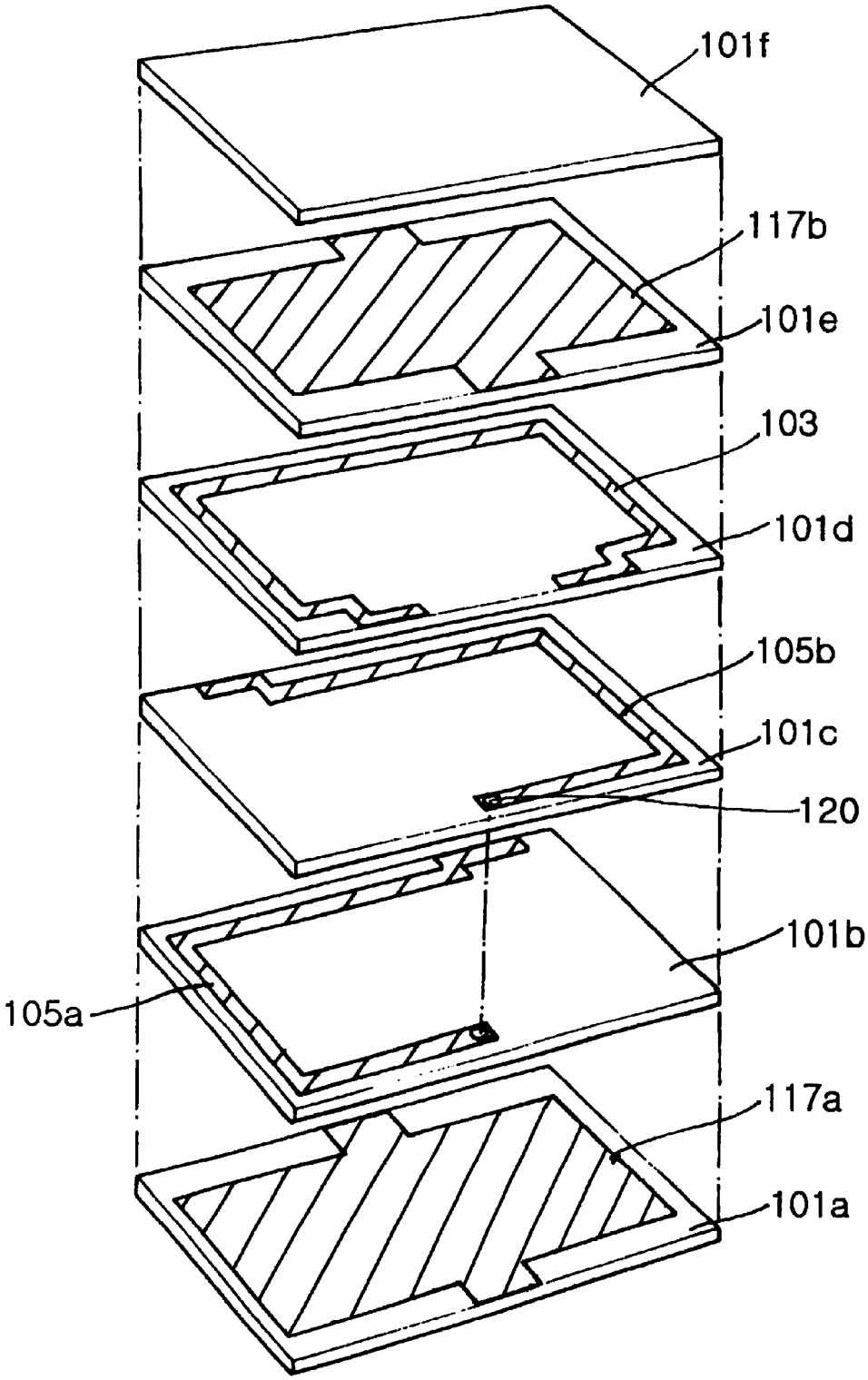
FIG. 3 is an exploded perspective view showing the structure of a multi-layer chip directional coupler according to a preferred embodiment of the present invention.

FIG. 3 is an exploded perspective view showing a multi-layer chip directional coupler according to a preferred embodiment of the present invention. Actually, the multi-layer chip directional coupler is formed as one coupler by cohering a plurality of layers. However, in the Drawing, the multi-layer chip directional coupler of this invention is shown to be exploded into a plurality of layers so as to describe the structure thereof. As shown in FIG. 3, the multi-layer chip directional coupler of this invention has a construction similar to that of a conventional coupler of FIG. 2

The multi-layer chip directional coupler of this invention is different from the conventional multi-layer chip directional coupler in that a main signal line and a coupling signal line are asymmetrically formed, and the main signal line is formed to be shorter than the coupling signal line. In the preferred embodiment, in order to shorten the main signal line, the main signal line is formed on one dielectric layer while the coupling signal line is formed on two dielectric layers. Such a structure is described in detail.

As shown in FIG. 3, a conductive metal such as copper (Cu) and silver (Ag) is layered on a dielectric layer 101*a* in the lower portion of the coupler, such that a ground pattern 117*a* is formed. Further, a dielectric layer 101*b* on which a coupling signal line 105*a* is formed by layering a conductive metal such as copper (Cu) and silver (Ag) similarly to the ground pattern 117*a* is arranged over the dielectric layer 101*a*. Further, a dielectric layer 101*c* on which a coupling signal line 105*b* connected to the coupling signal line 105*a* through a via hole 120 is formed is arranged over the dielectric layer 101*b*. As described above, the coupling signal lines 105*a* and 105*b* are connected to each other through the via hole 120, thus forming one coupling signal line.

Further, a dielectric layer 101*d* on which a main signal line 103 is formed by layering a typical conductive metal such as copper (Cu) and silver (Ag) is arranged over the dielectric layer 101*c*. A dielectric layer 101*e* on which a ground pattern 117*b* is formed is arranged over the dielectric layer 101*d*, and a case 101*f* made of an insulating material is arranged over the dielectric layer 101*e*.

Even though not shown in the Drawing, after the layers 101*a* to 101*f* are cohered with each other, an input port, an output port and a ground port are formed in the front portion of the cohered structure (namely, each front side of the layers), and a coupling port, a ground port and an isolation port are formed in the back portion of the cohered structure (namely, each back side of the layers). Therefore, the input and output ports, the ground ports, and coupling and isolation ports are respectively connected to the main signal line 103, ground patterns 117*a* and 117*b*, and the coupling signal lines 105*a* and 105*b*, which are formed on each corresponding layer.

As described above, in the multi-layer chip directional coupler, the coupling signal lines 105*a* and 105*b* are respectively formed on two dielectric layers 101*b* and 101*c* and connected to each other through the via hole 120. Further, the main signal line 103 is formed on the dielectric layer 101*d* arranged over the two dielectric layers 101*b* and 101*c*. Therefore, the main signal line and the coupling signal lines are asymmetrically formed in comparison with the conventional coupler in which main and coupling signal lines are symmetrically formed. In other words, the main signal line 103 is even shorter than the entire length of the coupling signal lines 105*a* and 105*b*. Further, the main signal line 103 is formed as a single layer.

This means that the manufacturing process of the coupler can be simplified, and in addition, the resistance of the conduction pattern is reduced and the insertion loss is decreased in comparison with the conventional directional coupler. Table. 1 shows the resistance, insertion loss, coupling coefficient and return loss with respect to the multi-layer chip directional coupler having the asymmetrical structure of this invention and the conventional multi-layer chip directional coupler having the symmetrical structure.

TABLE 1

| | Signal line Length | | Rdc (mΩ) | | | | |
|---|---|---|---|---|---|---|---|
| | Main Signal Line | Coupling Signal Line | Main Signal Line | Coupling Signal Line | Insertion Loss (dB) | Coupling Coefficient (dB) | Return loss (VSWR) |
| Comparative Example | 6.16 | 6.16 | 242 | 230 | 0.263 | 13.8 | 1.112 |
| Embodiment 1 | 4.30 | 6.16 | 183 | 237 | 0.244 | 14.2 | 1.083 |
| Embodiment 2 | 3.55 | 6.16 | 116 | 225 | 0.231 | 14.3 | 1.134 |
| Embodiment 3 | 2.52 | 6.16 | 94 | 253 | 0.183 | 15.6 | 1.153 |

As shown in Table 1, four multi-layer chip directional couplers were manufactured such that their return losses were nearly the same. The four multi-layer chip directional couplers comprised dielectric substrates of the same size and same material. However, the four directional couplers were made to be different from each other in the length of each main signal line. In other words, in the directional coupler according to the comparative example, both the main signal line and the coupling signal line were constructed to have the same length, similarly to the conventional coupler having the symmetrical structure. On the other hand, in the directional couplers according to the first to third embodiments, the length of each main signal line was respectively set to 4.30 mm, 3.55 mm and 2.52 mm such that the main signal line was shorter than the coupling signal line. Then, the insertion loss and the coupling coefficient were calculated with respect to the comparative example and the first to third embodiments under the same conditions.

Subsequently, as shown in Table 1, the moot remarkable insertion loss can be seen in the third embodiment, in which the main signal line is shortest among the embodiments. In other words, the insertion loss can be reduced by shortening the main signal line. However, Table 1 shows that even though the insertion loss can be greatly reduced, the coupling coefficient is excessively increased in the third embodiment. Therefore, the shortening of the main signal line for reducing the insertion loss is restricted due to the coupling coefficient value. In consideration of this, it is preferable to set the length of the main signal line adapted to the present invention to be approximately half that of the coupling signal line as shown in the second embodiment.

As described above, the present invention provides a multi-layer chip directional coupler, in which main and coupling signal lines are asymmetrically formed, and the main signal line is set to be shorter than the coupling signal line, such that the resistance of the main signal line is reduced, thus significantly decreasing the insertion loss. Especially, the present invention is advantageous in that it can greatly reduce the insertion loss while maintaining an appropriate coupling coefficient in the case that the length of the main signal line is set to be a half that of the coupling signal line.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-layer chip directional coupler, comprising:

a first ground pattern formed on the upper surface of a first dielectric layer;

a coupling signal line formed of a conduction pattern on the upper surface of a second dielectric layer formed over the first dielectric layer;

a main signal line formed of a conduction pattern on the upper surface of a third dielectric layer formed over the second dielectric layer, the main signal line being shorter than the coupling signal line;

a second ground pattern formed on the upper surface of a fourth dielectric layer formed over the third dielectric layer; and a plurality of ports formed on the side surfaces of the first to fourth dielectric layers and connected to the main signal line, the coupling signal line, and the first and second ground patterns.

2. The directional coupler according to claim 1, wherein the second or third dielectric layer is comprised of a plurality of layered dielectric layers, and conduction patterns forming coupling signal lines or main signal lines respectively formed on the second or third dielectric layer are connected to each other through a via hole penetrating through a plurality of dielectric layers.

3. The directional coupler according to claim 1, wherein the length of the main signal line is approximately 50~80% of that of the coupling signal line.

4. The directional coupler according to claim 1, wherein the main signal line is set to be approximately half that of the coupling signal line in length.

* * * * *